United States Patent [19]

Kasevich

[11] Patent Number: 5,065,819

[45] Date of Patent: Nov. 19, 1991

[54] ELECTROMAGNETIC APPARATUS AND METHOD FOR IN SITU HEATING AND RECOVERY OF ORGANIC AND INORGANIC MATERIALS

[75] Inventor: Raymond S. Kasevich, Weston, Mass.

[73] Assignee: KAI Technologies, Woburn, Mass.

[21] Appl. No.: 491,005

[22] Filed: Mar. 9, 1990

[51] Int. Cl.[5] ..... E21B 36/04; E21B 43/24

[52] U.S. Cl. ..... 166/248; 405/128

[58] Field of Search ..... 166/245, 248, 60; 219/10.55 R, 10.65, 10.81; 405/128

[56] References Cited

U.S. PATENT DOCUMENTS

| | | | |
|---|---|---|---|
| Re. 30,738 | 9/1981 | Bridges et al. | 166/248 |
| 2,634,961 | 4/1953 | Ljungstrom . | |
| 3,848,671 | 11/1974 | Kern | 166/248 |
| 4,008,765 | 2/1977 | Anderson et al. | 166/272 |
| 4,140,179 | 2/1979 | Kasevich et al. | 166/248 |
| 4,140,180 | 2/1979 | Bridges et al. | 166/248 |
| 4,193,451 | 3/1980 | Dauphine | 166/248 |
| 4,301,865 | 11/1981 | Kasevich et al. | 166/248 |
| 4,398,597 | 8/1983 | Haberman | 166/248 X |
| 4,449,585 | 5/1984 | Bridges et al. | 166/248 |
| 4,457,365 | 7/1984 | Kasevich et al. | 166/60 |
| 4,485,868 | 12/1984 | Sresty et al. | 166/248 |
| 4,485,869 | 12/1984 | Sresty et al. | 166/248 |
| 4,524,827 | 6/1985 | Bridges et al. | 166/248 |
| 4,545,435 | 10/1985 | Bridges et al. | 166/248 |
| 4,553,592 | 11/1985 | Looney et al. | 166/248 |
| 4,583,589 | 4/1986 | Kasevich | 166/60 |
| 4,638,862 | 1/1987 | Savage | 166/248 |
| 4,645,004 | 2/1987 | Bridges et al. | 166/248 |
| 4,670,634 | 6/1987 | Bridges et al. | 219/10.41 |
| 4,700,716 | 10/1987 | Kasevich et al. | 128/804 |
| 4,705,108 | 11/1987 | Little et al. | 166/248 |

FOREIGN PATENT DOCUMENTS 1199106 7/1986 Canada .

OTHER PUBLICATIONS

Moore, Steven D., "Meridian Oil Finds Success With Horizontal Wells," Petroleum Engineer International, pp. 17-22, 11/89.

Anderson, I., "Steam Cleaning Deals With Toxic Waste," New Scientist, p. 31, Nov. 26, 1988.

*Primary Examiner*—William P. Neuder

*Attorney, Agent, or Firm*—Hale and Dorr

[57] ABSTRACT

The disclosure describes an electromagnetic apparatus, and a method of use thereof, for simultaneously generating near-uniform heating in a subsurface formation and simultaneously recovering organic and inorganic materials through the apparatus itself. The apparatus may be constructed from flexible or semi-rigid materials for use in horizontal borehole applications. The disclosure also describes a phase-modulated multiple borehole system, and a method of use thereof, for heating larger subsurface volumes and for creating steerable and variable heating patterns. The apparatus and system described herein may be used for recovering oil trapped in rock formations and for decontaminating a region of the earth contaminated with hazardous materials.

34 Claims, 6 Drawing Sheets

ELECTROMAGNETIC APPARATUS AND METHOD FOR IN SITU HEATING AND RECOVERY OF ORGANIC AND INORGANIC MATERIALS

BACKGROUND OF THE INVENTION

The present invention relates to the use of electromagnetic energy to assist in the recovery of organic and inorganic materials (for example, liquids and gases) from subsurface formations (for example, oil shale, tar sands, heavy oil, sulfur and other bituminous or petroliferous deposits) and, in particular, to an in situ electromagnetic apparatus, and a method of use thereof, for simultaneously heating and recovering organic and inorganic materials in a single borehole or a multiple borehole system.

The large scale commercial exploitation of certain subsurface mineral formations has been impeded by a number of obstacles, particularly the cost of the extraction and the environmental impact of above-ground mining. Organic material such as oil shale, tar sands, coal, and heavy oil can be subjected to heating to develop the porosity, permeability and/or mobility necessary for recovery. The high viscosity of bitumen and heavy oils in their native condition makes these substances extremely difficult to recover from subsurface formations. For example, it is not economically feasible to recover bitumen from tar sands by strip-mining and above-ground processing. Although in situ processing based on conventional (that is, non-electromagnetic) heating methods would have economic advantages and avoid severe environmental problems, all conventional in situ techniques are inadequate because of the difficulty in transferring heat through the subsurface mineral formation (since the mineral deposits are poor thermal conductors and are often impermeable to fluids). This problem is avoided by using electromagnetic methods of heating.

Previous efforts have been proposed to heat large volumes of subsurface formations in situ using electromagnetic energy. Investigators have explored the technical feasibility of using radio frequency energy for the volumetric heating of Utah tar sands. In order to achieve reasonable rates of product recovery by in situ tar sand processes, it is necessary to lower the viscosity of the bitumen (the rate of flow of bitumen within the deposit is inversely proportional to the viscosity). For example, the viscosity of bitumen from Utah tar sand deposits is greater than $10^6$ centipoise (cp) under reservoir conditions, and can be reduced to about 100 cp by heating the deposits at 125°-150° C. Under these conditions, the bitumen can be recovered either by gravity drive, gas injection, or by replacement of the bitumen with a suitable subsurface solution (liquids or gases). Alternatively, the bitumen can be pyrolyzed in situ and the oil product recovered by gas expansion and gravity drive. Prior electromagnetic methods also describe a transmission line system which is essentially a triplate structure composed of many closely spaced electrodes. Although this system demonstrates the ability of electromagnetic energy of appropriate frequency to heat tar sand material to elevated temperatures, product recovery is still required.

The stimulation of production from individual wells in heavy-oil deposits is generally difficult because the liquid flow into the borehole region may be impeded by the high viscosity of the oil, the precipitation of paraffin from the rock matrix, or the presence of water sensitive clays. The application of a modest amount of electromagnetic energy for heating around and away from the borehole will reduce the viscosity of the heavy oil. As a result, the liquid flow pattern will improve and the pressure gradient around the borehole will be reduced, thereby increasing overall production rates. Even greater increases in flow rates can be achieved by extending the heating patterns further out into the deposit by either lowering the radio frequency or by using more than one apparatus.

There has been considerable interest in developing in situ techniques in which electrical energy is employed to heat the borehole and through conduction to heat the subsurface formation to recover useful fuels. These approaches have not been successful because (i) they failed to heat the particular resource in significant volume and/or (ii) they depended upon ambient water to provide electrical conductivity. For example, one technique describes simple electrical heating elements which are embedded in pipes and the pipes inserted in boreholes in oil shale. Although this approach is technically feasible, it creates a very high temperature gradient around the boreholes. This results in an inefficient use of the applied energy, a very low level of useable heat per borehole and, consequently, a requirement for very closely spaced boreholes.

Alternative electrical in situ techniques have been proposed wherein the electric conductivity of the subsurface formation is relied upon to carry an electric current between electrodes inserted in separated boreholes. For example, sixty cycle (Hz) ohmic heating methods have been proposed in which electrical currents are passed through a tar sand deposit. As typically described, a simple pair of electrodes is placed into a subsurface mineral deposit and a 60 Hz voltage is applied. However, this technique is problematic: AC current will flow between the electrodes because the presence of water in the deposit allows mobile ions to lower the observed electrical resistance. Then, as heating continues, high current densities near the electrodes evaporate the local moisture, thereby terminating the heating process. Attempts to mitigate this effect have included injecting saline water from the electrodes and pressurizing the deposit to suppress vaporization. Even if these techniques were successful, the current density would be higher near the electrodes. This would cause inefficient transfer of electrical energy and result in unfavorable economics. Furthermore, many tar sand deposits are poor candidates for this technique because they have a low moisture content which prevents a reduction in electrical resistance, and a thin overburden which makes pressurization difficult.

Techniques for in situ oil shale retorting by employing radio frequency energy have been described in the patent literature. Some of these techniques use borehole applicator systems which have been successfully tested in the field for kerogen heating and subsequent oil recovery. The efficient transfer of RF energy away from the boreholes was accomplished through the appropriate choice of frequency, applicator design and input power control. During power application, initial heating occurred near the boreholes with attendant oil recovery followed by much large volumetric heating between boreholes. In some instances, the resulting oil product has been recovered by the antenna acting as an extractor. Oil vapor pressure and injected gas flow have been employed to assist in product recovery.

Thus, it is an object of the present invention to provide an electromagnetic apparatus, and a method of use thereof, for generating near-uniform heating of subsurface formations and simultaneously recovering organic and inorganic materials through the apparatus itself.

It is another object of this invention to provide a flexible or semi-rigid electromagnetic apparatus for simultaneously heating and recovering organic and inorganic materials in substantially horizontal boreholes.

It is yet another object of this invention to provide a phase-modulated multiple borehole system, and a method of use thereof, for generating near-uniform heating and simultaneously recovering organic and inorganic materials from larger subsurface formations and for creating steerable and variable heating patterns.

It is still another object of this invention to provide an electromagnetic apparatus, and a method of use thereof, for recovering oil trapped in rock formations.

It is still yet another object of this invention to provide an electromagnetic apparatus, and a method of use thereof, for decontaminating a region of the earth contaminated with hazardous materials.

SUMMARY OF THE INVENTION

This invention relates to an in situ electromagnetic apparatus, and a method of use thereof, for simultaneously heating and recovering organic and inorganic materials in a single borehole or multiple borehole system. Each individual apparatus (radio frequency antenna coupled to coaxial transmission line) is designed to extract the heated product through the antenna apparatus itself by means of a production flow line which is in fluid communication with a sump at the bottom of the borehole and a storage facility. In one embodiment, this invention describes a flexible antenna apparatus for heating and recovering organic and inorganic materials in substantially horizontal boreholes.

The radio frequency antenna is based on the collinear array disclosed in Kasevich et al., U.S. Pat. No. 4,700,716, which is incorporated herein by reference. However, the distal section of the collinear array antenna described herein has apertures which are designed as portals (or inlets) to collect the processed organic or inorganic liquids.

A phase-modulated multiple borehole system, which includes a geometric array of antenna apparati, is used for near-uniform heating of larger subsurface formations and for creating steerable and variable heating patterns by phasing the current to the individual apparati.

A single antenna apparatus or a phase-modulated multiple borehole system can be used to decontaminate regions of the earth or storage tanks which are contaminated with hazardous materials (for example, volatile organic compounds, sludges, solvents, oils, greases and coal tar sludge residue).

These and other aspects, objects and advantages of the present invention will become apparent from the following detailed description, particularly when taken in conjunction with the accompanying drawings.

DETAILED DESCRIPTION OF PREFERRED EMBODIMENTS OF THE INVENTION

The present invention relates to the use of electromagnetic energy to assist in the recovery of organic and inorganic materials from subsurface formations. In general, the invention relates to an in situ electromagnetic apparatus, and a method of use thereof, for simultaneously generating near-uniform heating and recovering organic and inorganic materials in a single borehole or a multiple borehole system. In particular, the electromagnetic heating is provided by one or more borehole antenna apparati (for example, a radio frequency antenna coupled to a coaxial transmission line) that are designed to simultaneously process (that is, heat) and extract the products to be recovered through the antenna apparati themselves. In a phase-modulated multiple borehole system, the current to each individual antenna apparatus can be appropriately phased relative to each other, and as a function of time, to provide steerable and variable heating patterns. In addition, the invention pertains to flexible antenna apparati that are designed for use in substantially horizontal or substantially vertical boreholes.

Figure 1:
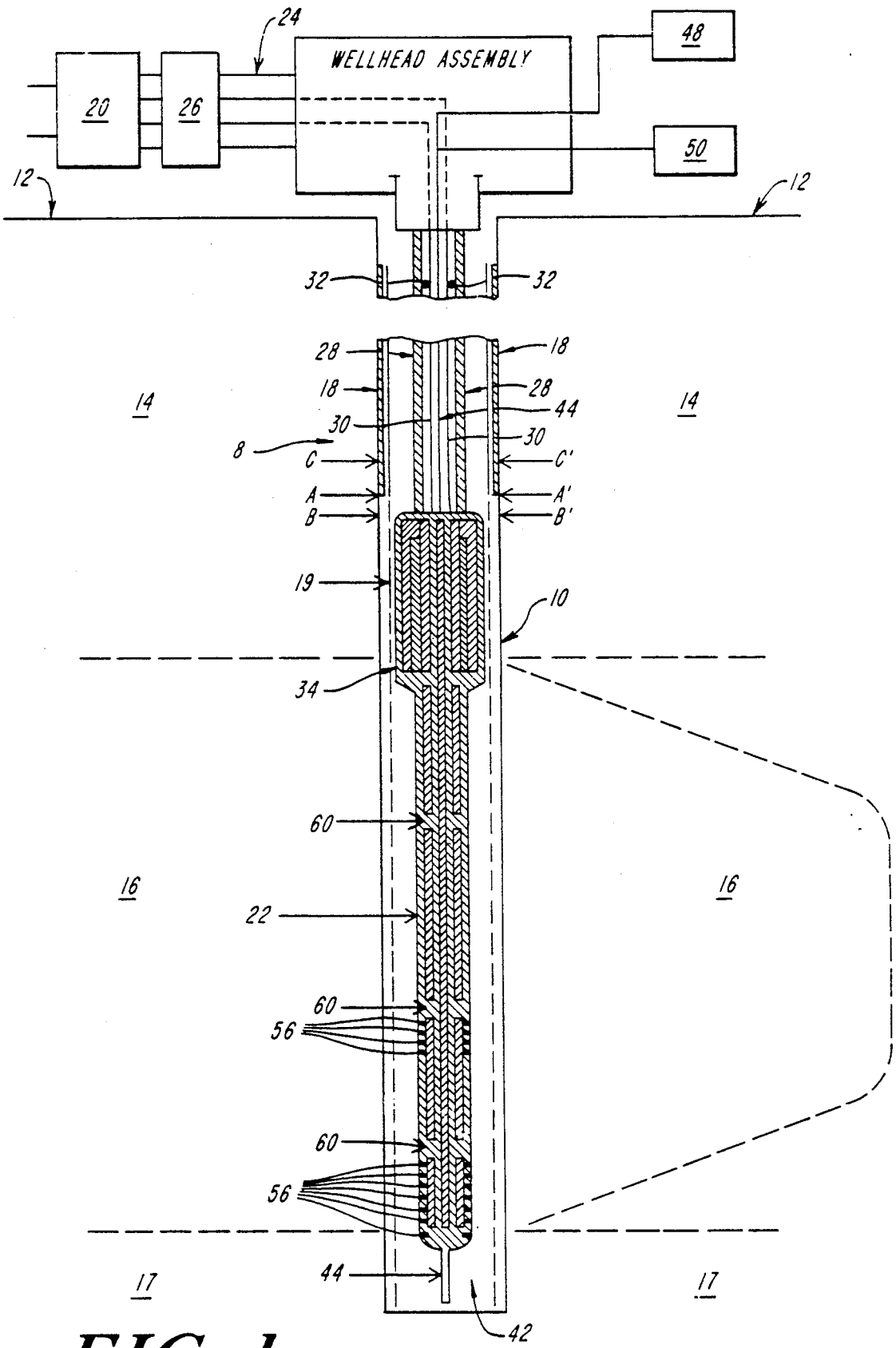
FIG. 1 is a vertical schematic sectional view of the borehole antenna apparatus of the present invention.
Figure 2:
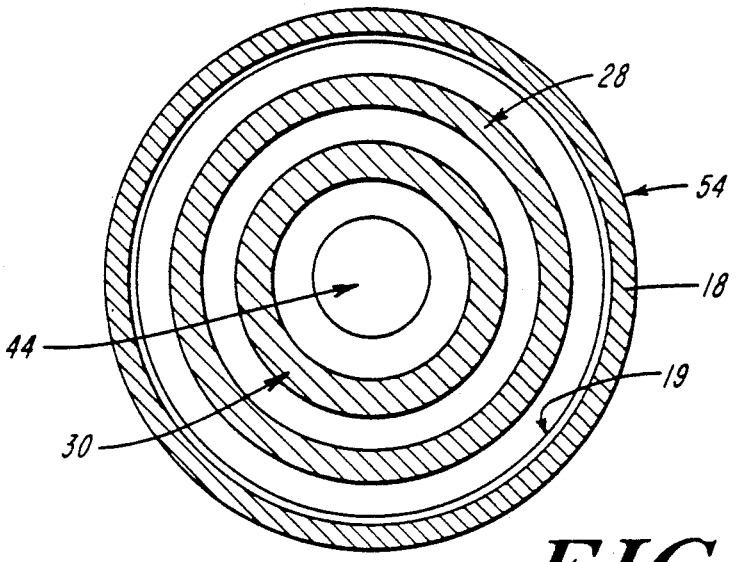
FIG. 2 is a cross-sectional view of the borehole antenna apparatus of FIG. 1 taken along line C—C'.
Figure 3:
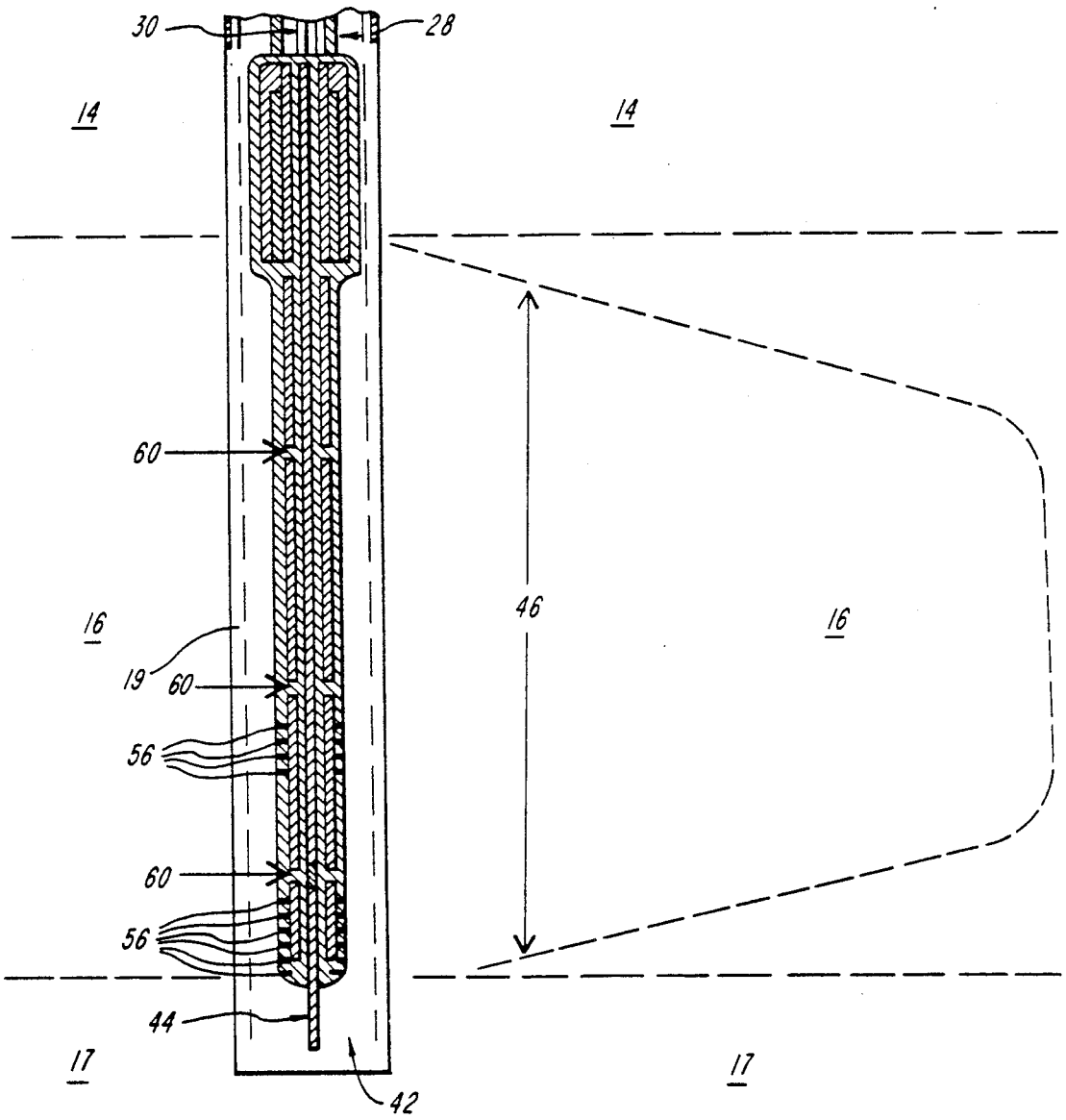
FIG. 3 is an enlarged view of the collinear antenna shown in FIG. 1.

Referring to FIGS. 1-3, the borehole antenna apparatus 8, in accordance with one preferred embodiment of the invention, is designed for simultaneously generating near-uniform heating and recovering organic and inorganic materials (for example, liquids and gases) from a subsurface formation. The subsurface formation may contain oil shale, tar sands, heavy oil, sulfur or other bituminous or petroliferous deposits. A borehole 10 is drilled into the earth to extend from the earth's surface 12 though an overburden layer 14 and into the region of a subsurface formation from which organic and inorganic materials are to be recovered (the "payzone" 16). The payzone 16 overlies an underburden 17. The borehole 10 is cased with a casing 18 in a conventional manner over its length through the overburden layer 14. Preferably, casing 18 is comprised of lengths of fiberglass casing or steel casing (for example, oil field casing) joined together and cemented in place in borehole 10. A radio frequency transparent liner 19 extends from the wellhead along the inner surface of casing 18 and through payzone 16 and underburden 17 to the bottom of borehole 10. Alternatively, radio frequency transparent liner 19 may be disposed in borehole 10 in vertical relation to casing 18, and joined thereto at position A—A'. The radio frequency transparent liner 19 is preferably made of a flexible non-conductive material such as plastic, fiberglass, polyvinyl chloride (PVC) or a similar material which can withstand a relatively moderate temperature environment (that is, approximately 100° C.). The section of liner 19 which is positioned adjacent to payzone 16 will have mechanical perforations to allow the liquid product to enter borehole 10.

A high power RF generator 20 transmits electromagnetic energy to a downhole radio frequency antenna over either a flexible or semi-rigid coaxial transmission line 24. The radio frequency antenna is shown in the form of a collinear antenna array 22 having three antennas fabricated from a coaxial transmission line comprising an inner conductor and an outer coaxial conductor with an impedance matching element (see below). The RF generator 20, which is preferably located on the earth's surface, is coupled to coaxial transmission line 24 by a coaxial liquid dielectric impedance matching transformer 26. The outer conductor 28 of coaxial transmission line 24 is a hollow tubular member, and the inner conductor 30 is a hollow tubular member of smaller diameter which is continuous through collinear array antenna 22. Outer conductor 28 of coaxial transmission line 24 and inner conductor 30 are spaced and insulated from one another by insulating spacers 32 (for example, ceramic discs). Multiple sections of coaxial transmission line 24 are coupled together in borehole 10 to form a string having sufficient length to reach payzone 16.

The collinear array antenna 22 is disposed in borehole 10 in coaxial relation to outer conductor 28 and coupled thereto at B—B′ through a bifurcated transformer and choke assembly 34 formed by an inner section 36 and a sleeve 38 separated by an insulator 40. The collinear array antenna 22, which is based on the collinear antenna array disclosed in Kasevich et al., U.S. Pat. No. 4,700,716, can operate at a selected frequency in the range of between about 100 kilohertz (KHz) to about 2.45 gigahertz (GHz).

The antenna 22 is coupled to the distal terminus of the string, as noted above, and extends into a sump 42 material collection region (for example, sump 42) at the bottom of borehole 10 such that antenna 22 may or may not be partially submerged in the liquid product being extracted from borehole 10. A production flow line 44, positioned inside inner conductor pipe 36, extends from a distal section 46 of collinear antenna 22 through coaxial transmission line 24 to a storage facility 48. Alternatively, production flow line 44 may project through an opening in the final quarter-wavelength section of collinear antenna 22 and into the liquid product which accumulates in sump 42. The production flow line is preferably made from plastic, PVC or a similar electrically non-conductive material. The heated liquid and/or gaseous products are lifted from sump 42 to storage facility 48 by an above-ground (for example, at the wellhead) lifting means 50 (for example, a rocker or Moyno type pump). Alternatively, the lifting means may be positioned in sump 42 or in the final quarter-wavelength section of collinear array antenna 22. A high pressure hose 52 from above-ground lifting means 50 can be positioned between the outer surface of casing 18 and a borehole wall 54 to create a pressure gradient which will assist in the recovery of liquid product through the production flow line 44.

Referring to FIG. 3, collinear antenna array 22 is a coaxial structure that provides a uniform distribution of radiated power along its length without leakage of power to the connecting coaxial transmission line. In accordance with the invention, one of the critical aspects of collinear array antenna 22 is the distal section 46. Apertures 56 in distal section 46 assist in the recovery of processed materials by providing a means for the flow of heated liquid product from the payzone into the distal section 46 of antenna 22. The apertures 56 may be of any desired size and spacing, depending on the rate of production of liquid product from the payzone and on the size of fractured pieces of the subsurface formation which cannot be allowed to pass into antenna 22.

As described in Kasevich et. al., U.S. Pat. No. 4,700,716, collinear array antenna 22 is formed by providing circumferential gaps 60 in the outer conductor 62 to expose the dielectric core 64 of the transmission line structure. Preferably, the widths of gaps 60 are about the same size as the distance between center conductor 66 and outer conductor 62. Core 68 may comprise a suitable solid dielectric insulator, such as aluminum oxide. Gaps 60 provide excitation feeds for more remote, for example, more distal end, antenna sections and result in the equivalent of more than one antenna pattern being generated from the length of the center conductor. The electrical lengths of these antenna sections are harmonically related to each other.

A dielectric outer envelope 70 extends over the outer surface of the applicator provided at the longitudinal axis of the applicator. In accordance with the theoretical and experimental teaching of Altschuler ("The Traveling-Wave Linear Antenna," E. E. Altschuler, Cruft Laboratory, Harvard University, Cambridge, MA *Scientific Report* No. 7, May 5, 1960), an essentially traveling-wave distribution of current can be produced on a linear antenna by inserting a resistance of suitable magnitude one-quarter wavelength from the end of the antenna. The effect of such resistance is to significantly change the radiation pattern of the antenna and therefore, in the present application, its heating pattern for the subsurface formation. The collinear array antenna 22 of the present invention is therefore provided with the appropriate value of resistance about one-quarter wavelength from the end of the distal section. By changing the applied frequency, or the location of the resistance, the distribution of heat around the antenna may therefore be changed or "steered" in planes passing through the antenna axis.

In operation, as the transmitted power from RF generator 20 is delivered through coaxial line 24 (formed by inner and outer conductors 28 and 30), each antenna section is exited and electromagnetic energy is radiated from the antenna and is absorbed by the subsurface formation of the payzone. The absorbed energy reduces the amplitude of the transmitted power. By increasing the number of elements at the distal end of the array (and decreasing the spacing between elements), a higher sectional antenna gain is achieved, as compared to the more proximal section B—C, which will have a lower gain because it is a single element.

Figure 4:
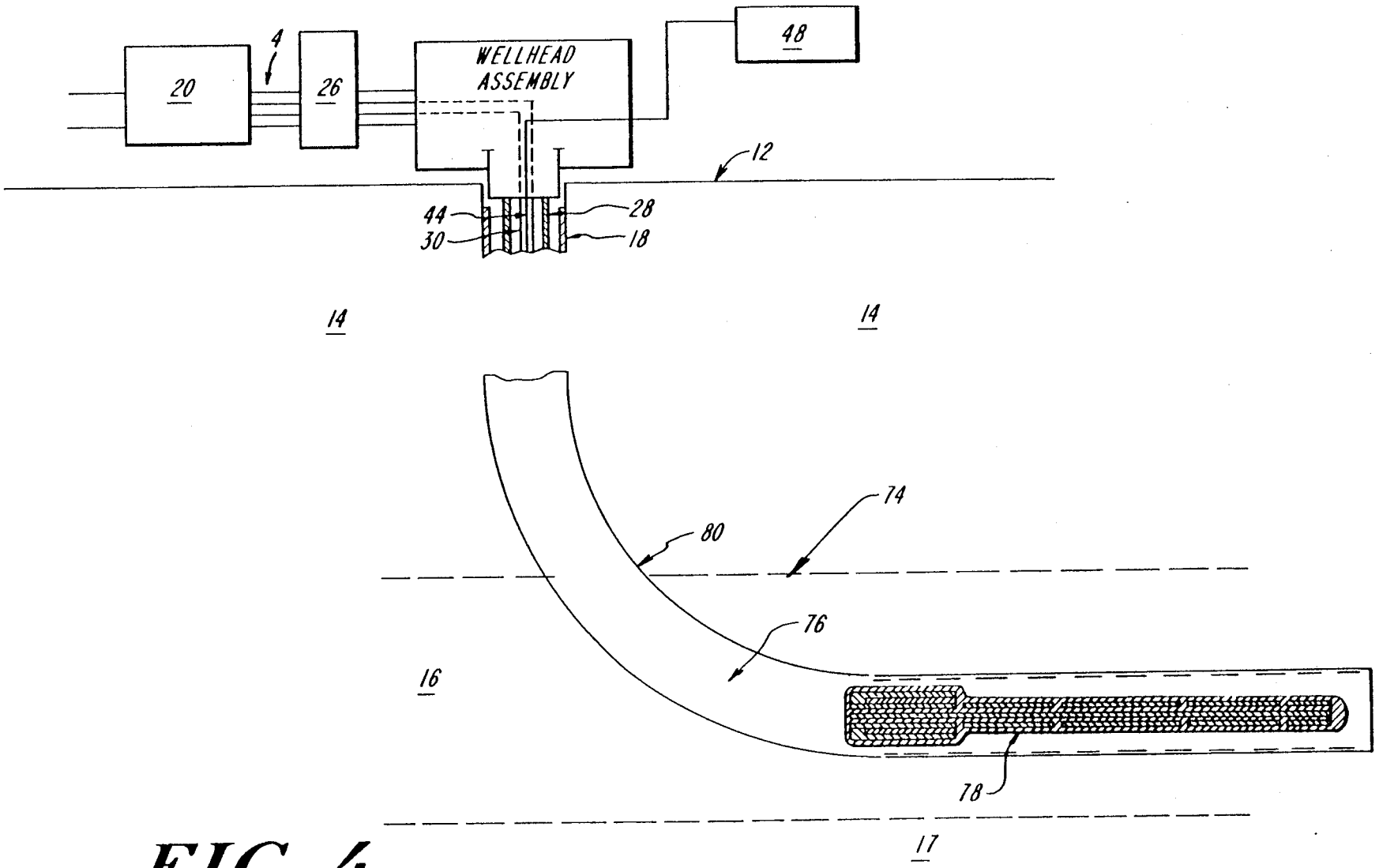
FIG. 4 is a vertical schematic sectional view of a flexible borehole antenna apparatus inserted into a substantially horizontal borehole.

Referring to FIG. 4, a flexible or semi-rigid antenna apparatus 74 is inserted into a substantially horizontal borehole 76 for heating and recovering organic and inorganic materials from payzone 16. Flexible antenna apparatus 74 is designed for use in a horizontal borehole 76 to provide a more economical recovery of organic and inorganic liquids liquid containing since fewer drilled holes are required when horizontal boreholes are used. Other applications for flexible antenna apparati include: wells drilled perpendicular to oil-filled vertical fractures for enhanced oil recovery and wells drilled in different directions from a single offshore platform.

The flexible antenna apparatus 74 may consist of a flexible or semi-rigid collinear antenna array 78 or a flexible or semi-rigid coaxial transmission line 80 or both. Flexible coaxial transmission line 80 and flexible collinear antenna 78 can be constructed from a composite of any of a number of different materials, including fiberglass, ceramics, teflon, plastics, metal laminates, composite materials of insulators and conductors, epoxy, fiber, clay-filled phenolics, and reinforced epoxy. Alternatively, the flexible coaxial transmission line and/or flexible collinear array antenna may be fabricated with flexible mechanical joints.

METHOD OF OPERATION

Referring to FIGS. 1-3, the high power RF generator 20, which operates at either a continuous wave (cw) or in a pulsed mode, supplies electromagnetic energy over the coaxial transmission line 24 to downhole collinear array antenna 22. The dielectric heating produced by the RF antenna extends radially away from the antenna and into payzone 16. The radial extent of the heating pattern from a single borehole apparatus will vary as a function of the operating frequency, the length of the RF antenna, and the electrical conductivity and dielectric constant of the lossy media (payzone 16). For example, other parameters being constant, applying energy at 1 megahertz (MHz) frequency will provide approximately a 100 foot diameter heating zone for enhanced product recovery. In comparison, applying energy at a 27 MHz frequency will provide approximately a 24 foot diameter heating zone.

Water converted to steam in the formation by RF energy will significantly enhance the extent of heat penetration from the borehole because of the attendant reduction in the material dielectric losses where steam is produced. Steam does not absorb RF energy while water does. When the system produces steam with oil, the diameter of the heating zone will expand to where the steam is not present and water begins. This expansion could be significant (for example, from the original 24 foot heating diameter to a 100 foot heating diameter at 27 MHz; and from the 100 foot heating diameter at 1 MHz to a several hundred foot heating diameter).

As the subsurface formation heats from the absorption of RF energy, the resulting organic or inorganic liquids will begin to flow toward borehole 10 assuming the borehole is kept at a low pressure (for example, pumped). The apertures 56 (or perforations) in the distal section 46 of antenna 22 act as portals to collect the heated liquids. The heated liquid will be transported by production flow line 44 to storage facility 48. Depending on the particular design of the apparatus employed, the liquid will either collect in sump 42 at the bottom of borehole 10 before being transported to storage facility 42, or the liquid will be immediately transported to storage facility 48 as the liquid enters distal section 46 of antenna 22. A mechanical pump or other pressure source is located either on the earth's surface, or in the final quarter-wavelength section of antenna 22, or in sump 42.

In FIG. 1, production flow line 44 extends from storage facility 48 through the center conductor 28 of coaxial transmission line 24 and the center conductor of collinear antenna 22 through an opening in the distal section 46 of antenna 22 and into sump 42.

The antenna apparatus of this invention is particularly well-suited for processing and extracting heavy oil from subsurface formations. In this application, a formation consisting of water, sand and highly viscous oil is heated to a maximum temperature of, for example, approximately 100° C. As this matrix heats from the absorption of RF energy, the heavy oil, along with hot water, will begin to flow toward the borehole (at lower pressure). The hot oil and water, which collect in sump 42, in combination with the partial submerging of the antenna, will change the load seen by RF generator 20. Therefore, to establish efficient impedance matching between RF generator 20 and collinear array antenna 22 immersed in organic or inorganic liquids in sump 42, a coaxial liquid-dielectric impedance transformer 26 is provided (See FIG. 1).

Figure 5:
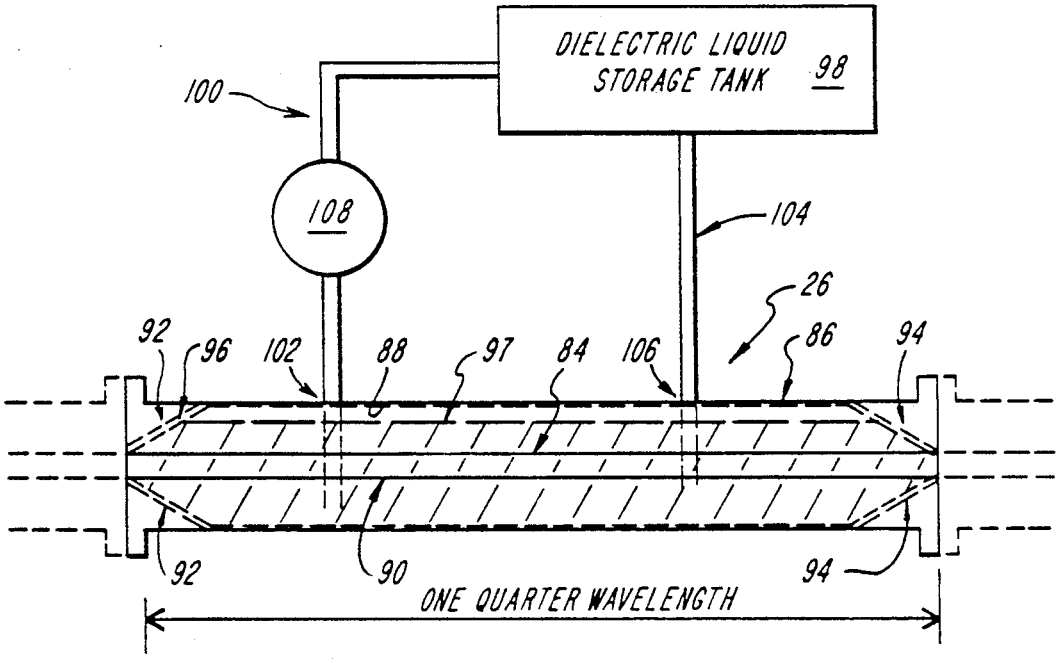
FIG. 5 is an enlarged cross-sectional view of the coaxial liquid dielectric impedance transformer shown in FIG. 1.

Referring to FIG. 5, coaxial transformer 26 is essentially a horizontally or vertically disposed liquid-filled (for example, silicone oil) vessel comprised of an inner conductor 84 and an outer conductor 86 to provide a specified characteristic impedance. (Preferably, the size of the diameter of inner conductor 84 is adjustable.) The inner surface 88 of outer conductor 86 and the outer surface 90 of inner conductor 84 are lined with a non-conductive material (for example, plastic or PVC) which is sealed at proximal flanges 92 and distal flanges 94 to form a dielectric liquid vessel 96. The dielectric liquid level 97 in vessel 96 controls the electrical length of the transformer and, therefore, its ability to transform the coaxial line impedance to the antenna impedance. Therefore, the dynamic impedance match between RF generator 20 and the downhole collinear array antenna can be adjusted to insure maximum power flow to the antenna and to insure a satisfactory impedance measurement, as represented by the Voltage Standing Wave Ratio (VSWR).

In order to adjust the liquid level within transformer 26, an auxiliary dielectric liquid storage tank 98 is provided in liquid communication with transformer 26 via a flow line 100 coupled to inlet 102 and a flow line 104 coupled to outlet 106. Pump 108 is provided as a means for transporting dielectric liquid between dielectric liquid storage tank 98 and coaxial transformer 26.

PHASE-MODULATED MULTIPLE BOREHOLE SYSTEM

In yet another embodiment of the invention, a multiple borehole phased array system processes and recovers organic and inorganic materials from large subsurface formation volumes by employing a minimum number of widely-spaced boreholes. However, to be suitable for commercial exploitation, a multiple borehole system will typically consist of at least approximately 30, and preferably 200 or more, individual antenna apparati inserted in boreholes arranged in a geometric pattern. A multiple borehole system may consist of flexible or semi-rigid antenna apparati inserted in either substantially vertical boreholes or a combination of substantially vertical boreholes and substantially horizontal boreholes.

Figure 6:
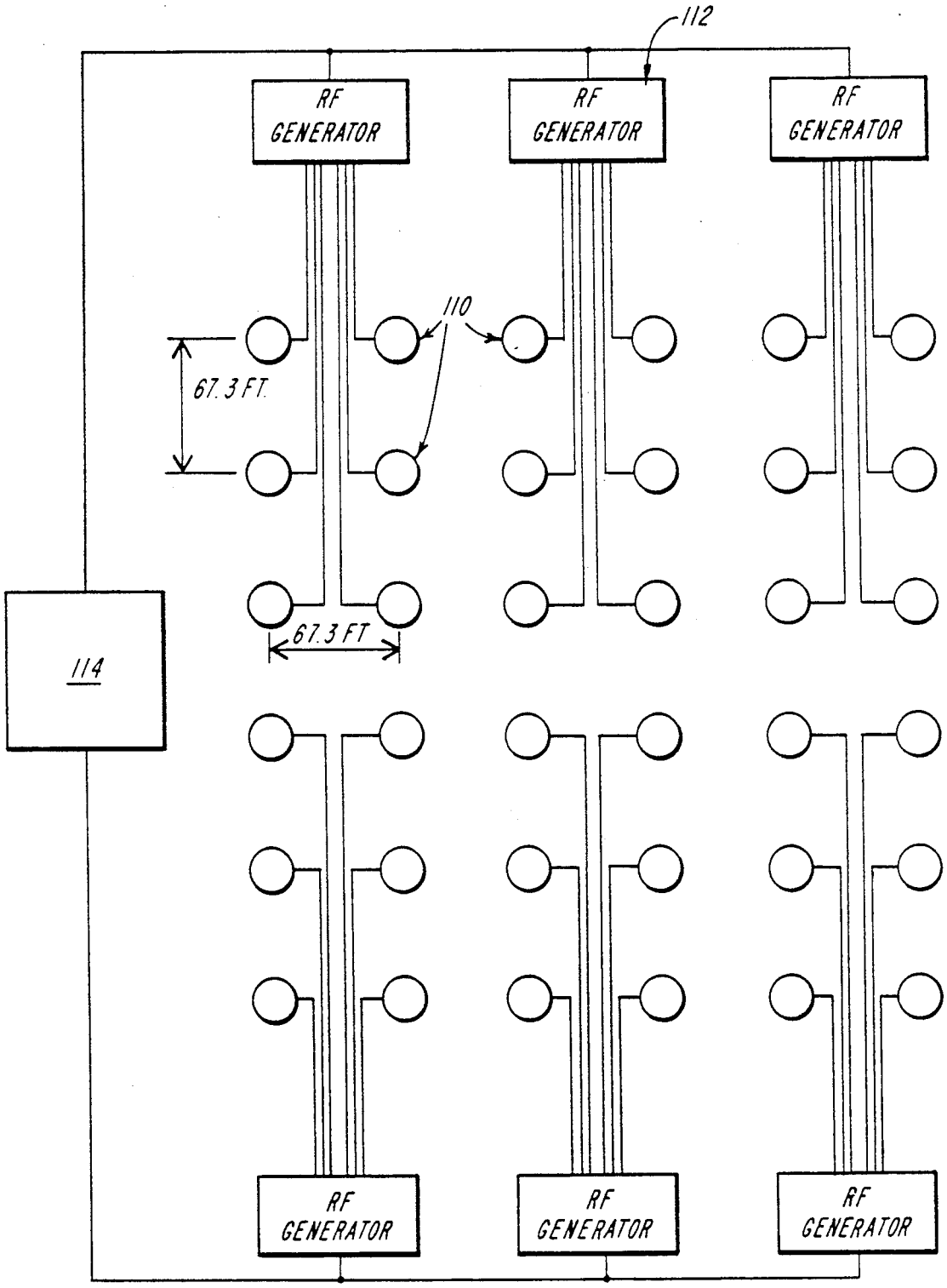
FIG. 6 is a schematic representation of a top view of a multiple borehole antenna apparatus system.

Referring to FIG. 6, a multiple borehole system for heating a subsurface formation is shown in which the payzone is 20 feet thick and occupies a square area of approximately three acres. At a radio frequency of approximately 14 MHz, this system consists of thirty-six antenna apparati 110 (described in FIG. 1) inserted in boreholes drilled in a square grid pattern, the grids being approximately sixty-seven feet apart. Each illustrated antenna borehole is approximately four to eight inches in diameter. The vertical borehole depth may be several hundred to several thousand feet to the bottom of the payzone. All antennas are powered by RF generators 112 (for example, approximately 25 kilowatts of power per borehole) that may be operated in either a cw or pulsed mode. Both the borehole temperature and feed-line VSWR are monitored in real time. This information is supplied to and used by a central computer 114 for power and phase control adjustment (throughout the heating period) to insure maximum production rates with time.

Figure 7:
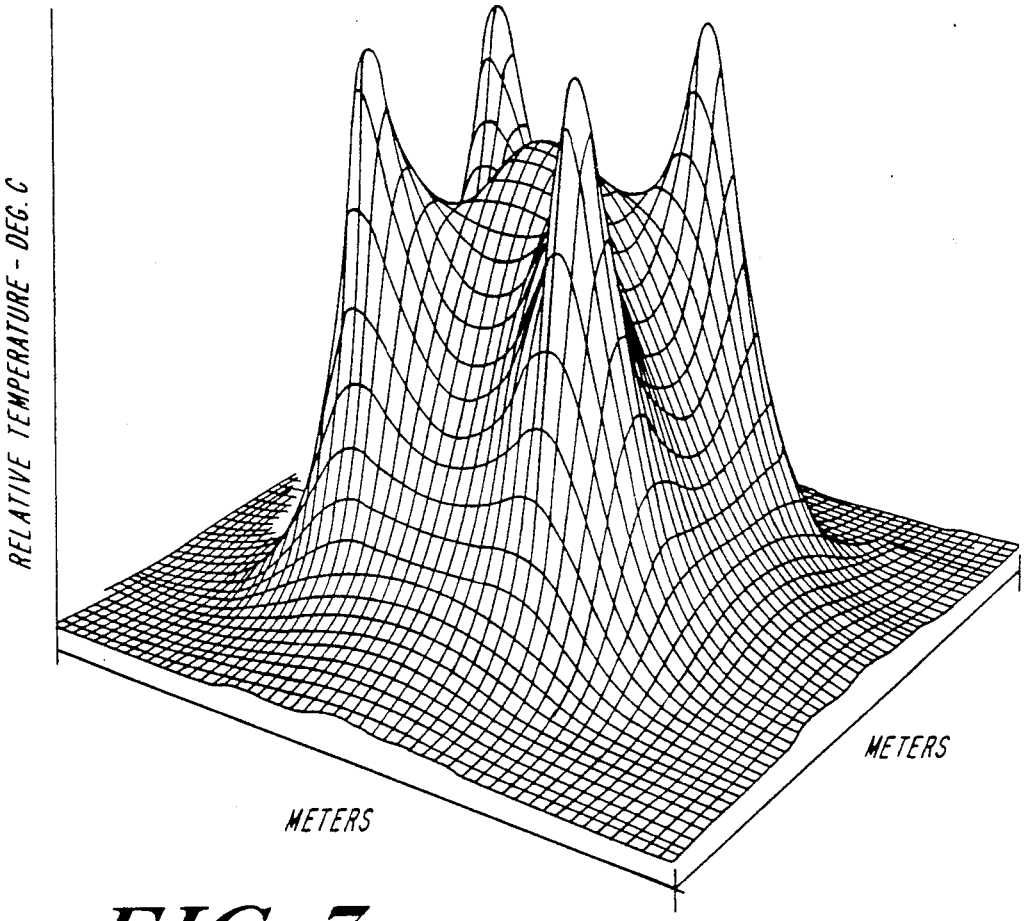
FIG. 7 is a graphical representation demonstrating the near-uniform heating generated in a four borehole system.

The phased array system is capable of providing a relatively near-uniform disposition of electromagnetic power in the payzone by proper antenna design, borehole spacing and choice of frequency and phase modulation. Referring to FIG. 7, the three-dimensional temperature distribution profile represents the temperature uniformity generated by a four borehole system (the boreholes being at the corners of a square) when all four input currents to the antennas are in time phase. In this example, the energy from one apparatus, at the selected frequency, will arrive at a second apparatus out of phase and will cancel a portion of the radiating field gradient. Thus, the heating effect in the regions immediately adjacent the respective apparati will be reduced while the radiating fields will have an additive effect in the central regions of the formation because of the choice of spacing and current phasing, thereby providing near-uniform, volumetric heating of the formation. Thus, when multiple apparati are properly spaced with different current phasings that may vary in time, a volumetric heating pattern is generated that essentially produces a uniform average temperature distribution throughout the payzone.

Initially, the region near each borehole will be higher in temperature than regions distant from the borehole; but this difference in temperature is reduced by using pulsed or reduced cw power into each antenna for a short period of time while still heating the formation further away (for example, using conduction to even out the temperature distribution). Eventually, a steady-state condition will exist whereby heating is relatively uniform throughout the formation. The heat distribution and focusing in the formation may be continuously altered by the computer to maintain even temperatures by phase modulation.

Figure 8A:
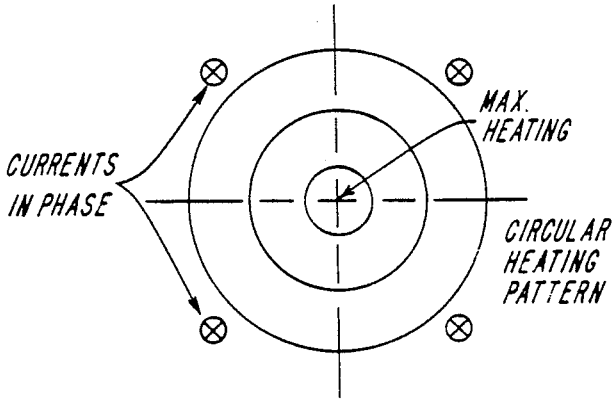
FIGS. 8*a* and 8*b* are schematic representation of the temperature profiles generated by two different current phasings in a phase-modulated borehole system.
Figure 8B:
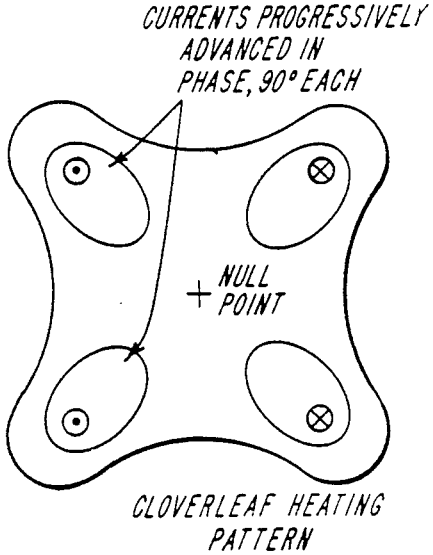

In the multiple borehole system disclosed herein, the phasing of currents may be varied on each antenna either sequentially or simultaneously (in time) to permit great latitude in the control of heating pattern dynamics and to insure temperature uniformity and temperature control near and away from the boreholes. Referring to FIG. 8, temperature profiles for two different phase conditions provide two different heating patterns. An example of a four borehole system with all currents in phase is shown in FIG. 8(*a*). An example of the same system with the relative current phases, working clockwise, being 0°, 90°, 180°, 270° is shown in FIG. 8(*b*). As illustrated, when all currents are in phase (FIG. 8(*a*)) a near-uniform heating pattern is generated in the equatorial plane; and a 90 degree progressive phase pattern (FIG. 8(*b*)) provides a null in the equatorial plane at the center of the array. A combination of these phasings, as well as intermediate values, will provide a steerable heating pattern to compensate for heat loss by conduction and hot spots in the pattern.

Referring to FIG. 6, the RF power transmitted to each apparatus of the multiple borehole system is controlled by the central computer 114. Each RF generator is in electrical communication with central computer 114. In addition, the central computer will receive information from each antenna apparatus 110 regarding the rate of oil production, the VWSR, and the temperature of the formation, so that individual adjustments in power cycling, current phasing and power level can be made.

The number of RF generators necessary in a multiple borehole system will depend on the production rate required for economic recovery. For example, a single 25 KW generator may be used to heat several boreholes sequentially in time. Twenty-five kilowatts of power will be applied to borehole 1 for a period of time sufficient to initiate production of liquid product. Borehole 1 will continue to recover liquid product as the RF generator is switched to borehole 2. Once production begins with borehole 2, the RF generator will be switched to borehole 3 and at boreholes 1 and 2 pumping will begin or continue. The residual heat near boreholes in 1 and 2 will be sufficient for some period of time to maintain production. As the production rate in borehole 1 diminishes, the generator will be electrically switched back to borehole 1 to maintain its production. By employing this matrix approach, the number of generators required is reduced.

THE RECOVERY OF OIL TRAPPED IN ROCK FORMATIONS

The borehole antenna apparatus of this invention may be used for the recovery of light grade crude oil which is trapped in rock formations or other impervious subsurface formations which lack suitable fractures or passages to allow the flow of liquid product. According to this aspect of the invention, an RF antenna having a frequency range of between 100 kilohertz (KHz) to 1 gigahertz (GHz) is coupled to a coaxial transmission line and inserted in either a vertical or horizontal borehole formed in the oil bearing rock formation. The moisture contained in the rock provides for the rapid absorption of RF energy, thereby creating thermal gradients. These gradients will cause the rock to fracture. Preferably, several antenna boreholes are employed and the current to the antennas is phase modulated to create a variable focal point which can be shifted in a prescribed pattern throughout the subsurface volume. The continuous fracturing of rock and other subsurface formations will create paths for oil flow to nearby wells.

ENVIRONMENTAL APPLICATIONS

The antenna apparatus of the present invention can be used also in many environmental applications, including the in situ decontamination of a region of the earth (for example, soil) contaminated with hazardous materials. In general, the apparatus is used to volumetrically heat, and thereby reduce the viscosity of, hazardous materials such as volatile organic compounds (for example, trichloroethylene), sludges, solvents, oils and greases. This process applies to organic soil contaminants as well as mixtures of organic and inorganic contaminants. Large volumes of contaminated soils can be treated at selected depths by using one or more apparati installed in subsurface wells or boreholes. The resulting liquid and/or gaseous products are recovered and transported to a storage facility by the antenna acting as an extractor as illustrated in FIGS. 1 and 2.

In a typical situation, the antenna would operate at nominally 10 kilowatts of average RF power at the Industrial Scientific Medical (ISM) frequency of 13.56 or 27.14 MHz depending on the volume and depth of the contaminated soil to be treated. The radiation developed by the apparatus is absorbed by the organic and inorganic materials through their dielectric loss. The dielectric constant of trichloroethylene as well as oils, greases, solvents and sludge materials corresponds to sufficient electrical loss to absorb RF energy in the range of 10 to 30 MHz. Water present in the contaminated soil absorbs the RF energy, thereby heating the contaminants by heat conduction. Large underground volumes of contaminated soil can be treated by this process. For example, four apparati arranged approximately 25 feet apart in a square pattern and having antennas of 20 feet in length could treat 12,500 cubic feet of contaminated soil.

In a related use, the apparatus of this invention can be used for the in situ heating of coal tar sludge residue contained in large metal storage tanks. As the temperature of coal tar rises, the coal tar becomes very lossy. In time, the viscosity of the sludge is reduced sufficiently to allow for substantially increased flow rates. The liquid and/or gaseous products are recovered in the manner described previously. The electromagnetic heating of coal tar sludge residue is an environmentally safe method for cleaning large storage tanks.

Additions, subtractions, deletions and other modifications of the described embodiments will be apparent to those practiced in the art and are within the scope of the following claims.

What is claimed is:

1. An apparatus for processing and extracting organic or inorganic materials from a subsurface formation wherein electromagnetic energy is transmitted from a radio frequency generator through a coaxial transmission line to a radio frequency antenna inserted in a borehole in said subsurface formation, said apparatus comprising:

a radio frequency antenna for radiating energy into said subsurface formation, said antenna having a plurality of apertures in a distal section;

a production flow line for connecting a material collection region of said borehole to a storage facility;

lifting means in operative connection with said production flow line for transferring said materials from said material collection region to said storage facility; and a coaxial dielectric liquid impedance transformer provided for quarter-wave impedance matching between said radio frequency generator and said antenna.

2. The apparatus of claim 1 wherein said radio frequency antenna is a collinear array antenna.

3. The apparatus of claim 1 further comprising means for extending said production flow line from said distal section of said antenna through said coaxial transmission line to said storage facility.

4. The apparatus of claim 1 further comprising means for extending said production flow line from said material collection region of said borehole through an opening in said distal section of said antenna to said storage facility.

5. The apparatus of claim 1 further comprising means for extending said production flow line from a pump at the bottom of said borehole through an opening in said distal section of said antenna and through said antenna and said coaxial transmission line to said storage facility.

6. The apparatus of claim 1 wherein said lifting means is a rocker pump or a moyno type pump.

7. The apparatus of claim 1 wherein said lifting means is located at one of a wellhead, said material collection region, and said distal section of said antenna.

8. An apparatus for simultaneously processing and extracting organic or inorganic materials from a substantially horizontal borehole in a subsurface formation, said apparatus comprising:

a flexible coaxial transmission line;

a flexible radio frequency antenna for radiating energy into said subsurface formation, wherein said antenna is coupled to a distal terminus of said coaxial transmission line;

said antenna having a plurality of apertures at its distal section for collecting of said organic and inorganic materials;

a production flow line;

a pump for lifting collected material from a material collection region of said borehole to said storage facility; and a coaxial dielectric liquid impedance transformer for providing quarter-wave impedance matching between said radio frequency generator and said subsurface formation.

9. The apparatus of claim 8 wherein said radio frequency antenna is a collinear array.

10. The apparatus of claim 8 further comprising means for extending said production flow line through an opening in said distal section of said antenna and into said material collection region of said borehole.

11. The apparatus of claim 8 further comprising means for extending said production flow line from said pump at the bottom of said borehole through an opening in said distal section of said antenna and through said antenna and said coaxial transmission line to said storage facility.

12. The apparatus of claim 8 wherein said coaxial transmission line and said antenna are constructed of composite materials wherein one of the components of said composite material is selected from the group consisting of fiberglass, plastic, polyvinyl chloride, ceramics, teflon, metal laminates, epoxy, fiber, clay-filled phenolics, and reinforced epoxy.

13. The apparatus of claim 8 wherein said antenna or said coaxial transmission line is fabricated with flexible mechanical joints.

14. The apparatus of claim 8 wherein said pump is positioned at one of a wellhead, said distal section of said antenna and said material collection region.

15. A flexible antenna apparatus for processing and extracting heavy oils from subsurface formations, said apparatus comprising a flexible coaxial transmission line and a flexible radio frequency antenna coupled to a distal terminus of said coaxial transmission line.

16. The flexible antenna apparatus of claim 15 further comprising apertures in the distal section of said flexible antenna for product recovery and a production flow line extending from the distal section of said antenna through said coaxial transmission line to a storage facility.

17. A system for processing and extracting organic and inorganic materials from a subsurface formation, said system comprising:

a plurality of borehole antenna apparati for radiating energy into said subsurface formation wherein said apparati are arranged according to a selected grid pattern array;

means for delivering electromagnetic energy to each of said antenna apparatus; and means for varying the phase of the energy delivered to each said apparatus for effecting phase modulation to provide near-uniform and controllable heating of said subsurface formation.

18. The system of claim 17 wherein each borehole antenna apparatus comprises:

a radio frequency antenna having a distal section;

a plurality of apertures in said distal section of said radio frequency antenna;

a production flow line extending from a material collection region of a borehole through said antenna structure at its distal section to a storage facility;

a pump for lifting recovered materials to said storage facility; and a coaxial dielectric liquid impedance transformer positioned at said wellhead for coupling energy from a radio frequency power source to said antenna.

19. The system of claim 17 wherein said boreholes are one of substantially vertical, substantially horizontal, and a combination thereof.

20. The system of claim 17 wherein said processing and said extracting occur simultaneously in each borehole.

21. The system of claim 17 further comprising a central computer for controlling the delivery of radio frequency power to said antennas.

22. The system of claim 21 further comprising means for varying the phasing of current to each antenna sequentially in time.

23. An apparatus for insertion into a borehole for the in situ decontamination of a region of the earth surrounding said borehole and contaminated with hazardous materials, said apparatus comprising:

a radio frequency antenna for radiating energy into said earth wherein said antenna is coupled to a coaxial transmission line for insertion into said borehole in said region;

said antenna having a plurality of apertures in a distal section of said antenna for recovering organic and inorganic materials from said region;

a production flow line extending from a material collection region of said borehole through said antenna and said coaxial transmission line to a storage facility;

means for enabling the lifting of said materials from said sump to said storage facility through said production flow line; and a coaxial dielectric liquid impedance transformer located at the wellhead for coupling said antenna to a power source.

24. The apparatus of claim 23 wherein said antenna is a collinear array.

25. The apparatus of claim 23 wherein said apparatus is comprised of flexible or semi-rigid materials.

26. The apparatus of claim 23 further comprising means for extending said production flow line through an opening in said distal section of said antenna and into a material collection region of said borehole.

27. A method for processing and extracting organic or inorganic materials from a subsurface formation, comprising the steps of:

radiating energy into said subsurface formation by means of a radio frequency antenna inserted into a borehole in said subsurface formation;

recovering said materials through a plurality of apertures in a distal section of said antenna; and transporting said materials to a storage facility by means of a production flow line extending from the distal section of said antenna to said storage facility.

28. The method of claim 27 further comprising the step of projecting said production flow line through an opening in said distal section of said antenna and into a material collection region of said borehole.

29. The method of claim 27 wherein said heating, recovering, and transporting steps occur simultaneously.

30. A method for processing and extracting organic or inorganic materials from a large subsurface formation, comprising the steps of:

inserting a plurality of borehole antenna apparati into a plurality of boreholes arranged in said large subsurface formation according to a selected grid pattern array;

providing near-uniform heating of said large subsurface formation by varying the phase of the energy delivered to each said apparatus for effective phase modulation;

recovering said materials through a plurality of apertures in a distal section of each said antenna apparatus; and transporting said materials to a storage facility by means of a production flow line.

31. A method of decontaminating a region of the earth contaminated with hazardous materials, comprising the steps of:

radiating energy into said region by means of a radio frequency antenna inserted in said region;

recovering said materials through a plurality of apertures in a distal section of said antenna; and transporting said recovered materials to a storage facility through a production flow line extending from said distal section of said antenna to said storage facility.

32. A method of heating and recovering organic and inorganic materials from a storage tank, comprising the steps of:

radiating energy into said tank by means of a radio frequency antenna inserted in said tank;

recovering said materials through a plurality of apertures in a distal section of said antenna; and transporting said recovered materials to a storage facility through a production flow line extending from said distal section of said antenna to said storage facility.

33. An apparatus for the in situ decontamination of a subsurface formation contaminated with hazardous materials, said apparatus comprising:

a radio frequency antenna for radiating energy into said subsurface formation, said antenna having a plurality of apertures in a distal section;

a production flow line for connecting a material collection region of said borehole to a storage facility; and lifting means in operative connection with said production flow line for transferring said materials from said material collection region to said storage facility.

34. The method of claim 31 further comprising the step of projecting said production flow line through an opening in said distal section of said antenna and into a material collection region of said borehole.

* * * * *